US006083076A

United States Patent [19]

Saint-Victor

[11] Patent Number: 6,083,076

[45] Date of Patent: Jul. 4, 2000

[54] ILLUMINATING AND SOUND PRODUCING STRING ACTIVATED ROTATABLE TOY

[76] Inventor: Emmanuel Saint-Victor, P.O. Box 450991, Atlanta, Ga. 31145

[21] Appl. No.: 08/996,301

[22] Filed: Dec. 22, 1997

[51] Int. Cl.[7] ..... A63H 1/24

[52] U.S. Cl. ..... 446/242; 446/236; 446/242; 446/247; 446/256; 446/258; 446/264; 446/265

[58] Field of Search ..... 446/242, 438, 446/254, 251, 253, 247, 249, 252, 256, 258, 259, 260, 265, 266, 236

[56] References Cited

U.S. PATENT DOCUMENTS

| | | | |
|---|---|---|---|
| 787,404 | 4/1905 | Schaller | 446/256 |
| 1,258,464 | 3/1918 | Riley | 446/254 |
| 1,431,604 | 10/1922 | Stenons | 446/236 |
| 1,886,385 | 11/1932 | Elivirdy . | |
| 2,151,600 | 3/1939 | Janzen | 40/433 |
| 2,554,063 | 5/1951 | Serrine | 362/806 X |
| 2,739,419 | 3/1956 | Cleveland | 446/253 |
| 2,957,271 | 10/1960 | Heywood, Jr. | 446/249 |
| 3,269,727 | 8/1966 | Samuel | 432/110 |
| 3,737,162 | 6/1973 | Wood | 482/110 |
| 4,002,893 | 1/1977 | Newcomb | 446/438 |
| 4,072,314 | 2/1978 | Rosen et al. | 446/404 X |
| 4,373,918 | 2/1983 | Berman | 446/408 X |
| 4,552,542 | 11/1985 | Reysman | 446/254 |
| 4,867,727 | 9/1989 | Lanius | 446/242 |

FOREIGN PATENT DOCUMENTS

| | | | |
|---|---|---|---|
| 18907 | 11/1989 | United Kingdom | 446/26 |

*Primary Examiner*—Robert A. Hafer
*Assistant Examiner*—Bena B. Miller
*Attorney, Agent, or Firm*—Hughes & Kaplan; Barry E. Kaplan, Esq.

[57] ABSTRACT

An illuminating and sound generating string rotatable toy comprising a sponge disk affixed near one end of a shaft penetrating a sphere. This disk may be rotated by pulling a string that extends perpendicularly from the shaft through a hole in the diameter of the sphere. The free end of that string is furnished with a ring through which a finger of the user of the toy may be inserted. The toy also include a variable illuminating and sound generating device inside the sphere. Upon rotation this illuminates and releases sound. Colorful designs upon the disk create a profusion of color or optical illusion during rotation.

17 Claims, 3 Drawing Sheets

ILLUMINATING AND SOUND PRODUCING STRING ACTIVATED ROTATABLE TOY

FIELD OF THE INVENTION

This invention relates to toys, particularly to a toy for automatically playing music, tones, tunes or voice messages upon rotation.

BACKGROUND OF THE INVENTION

Manually actuated and string manipulated toys are known to exist in the prior art. For instance, the toy known as a "yo-yo" has been used for many years. The "yo-yo" is a rotatable device suspended from or tethered to a string at one end and rotated through single band actuation at an opposite end. Similarly, paddle balls found in the prior art provide a ball tethered at one end of an elastic member with the other end connected to a paddle. The paddle is manipulated back and forth so that the ball bounces off the paddle in a continuous reciprocal action.

Additionally, manually actuated exercising devices are in existence today for physical conditioning. These devices normally comprise hand-maneuvered, stretchable or elastic material, incorporating a handle on each end of the material for stretching in front of the user. The handles are grasped with the hands and pulled apart against the stretch tension to build upper torso and arm strength. Such exercise may be considered boring and repetitious because of the static nature inherent in the exercising device.

BRIEF SUMMARY OF THE INVENTION

In accordance with the several objects of this invention, presented is a new and improved illuminating and sound producing string activated rotatable toy.

In a preferred embodiment, the present invention comprises a generally spherical casing, a sponge disk, a friction roller, a string and a printed circuit board (PCB), all carried by a shaft. The PCB, contained within the casing, comprises sound and illumination circuitry that is activated by the rotation of the device. In use, the user rotates the casing while holding the distal end of the string to wind the string about the shaft. Next, while holding the distal end of the string, a user spins the device about the shaft or allows it to spin while falling, thereby causing the motion activated PCB to generate a sound and/or an illumination. The casing has a plurality of apertures to allow the sound and/or illuminations to discharge from the casing and thus be heard and/or seen by the user. Once the string has been allowed to unwind or through additional upward force by the user, the centrifugal force will cause the device to be urged back to the user and thereby rewinding the string. At the same time, the motion activated PCB will generate additional sound and/or illuminations.

Accordingly, several objects and advantages of the invention are to provide a toy which provides more amusement, enjoyment, and pleasure to children and to adults, and to provide in addition, a rotatable toy which enhances the value of such toy to user and spectator. Another advantage of the toy is that it may be made with a sponge disk so the user and any spectator are free from getting hurt. Further objects and advantages will become apparent from a consideration of the drawings and ensuing description of the preferred embodiment.

DETAILED DESCRIPTION OF THE PREFERRED EMBODIMENT

Figure 1:
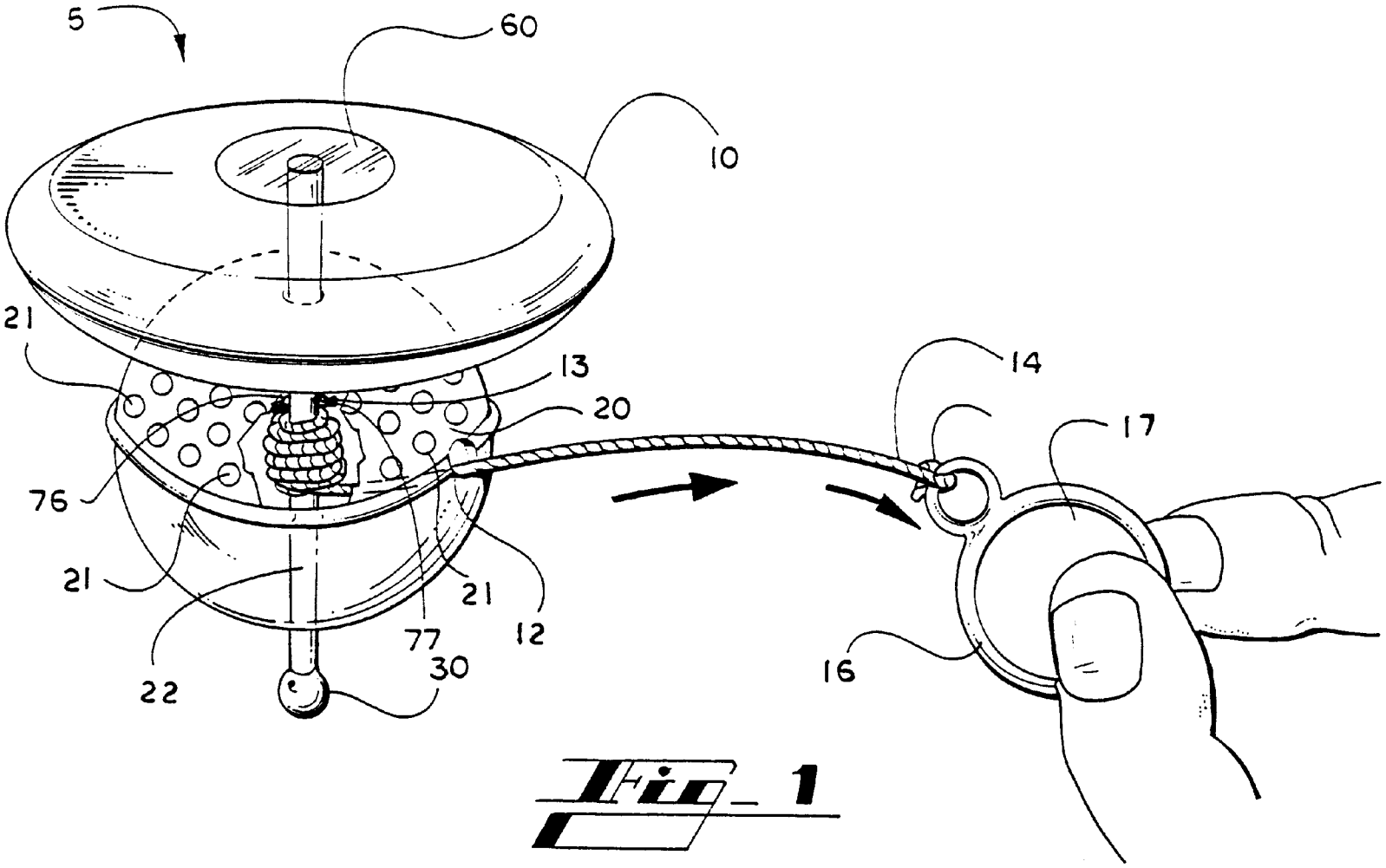
FIG. 1 is a perspective view of the string activated rotatable toy having illuminating and sound producing means and further having a disk made of sponge affixed near one end of a shaft penetrating a sphere according to a preferred embodiment.

A preferred embodiment of the invention is shown in FIG. 1. Here an activated string rotatable toy is provided with an illuminating and sound producing device.

Figure 2:
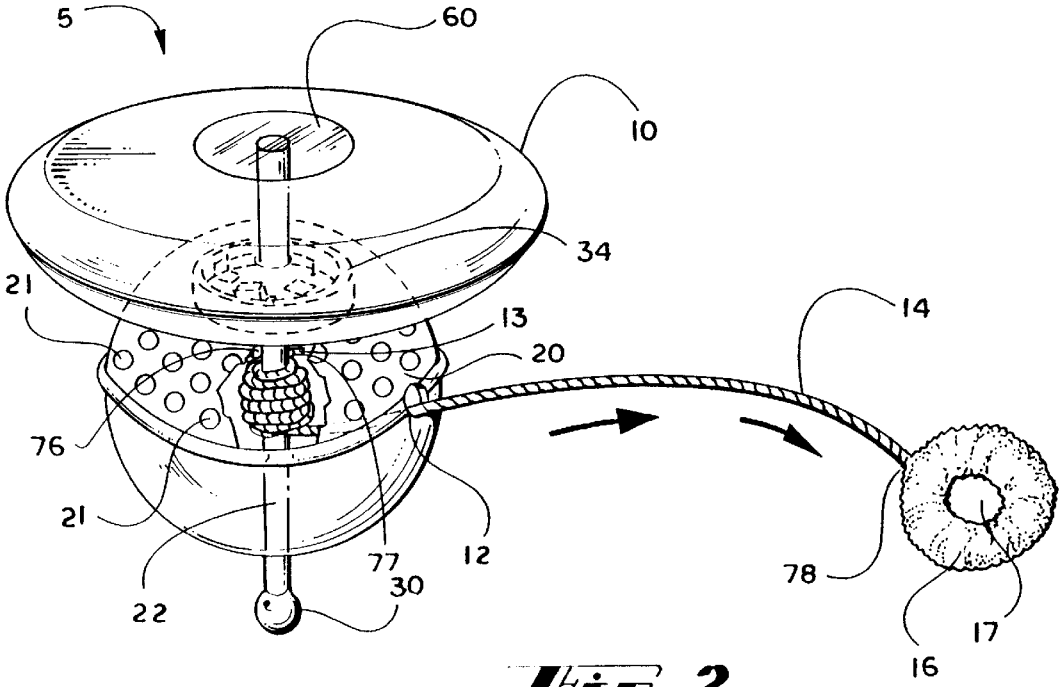
FIG. 2 is a perspective view of the invention made completely transparent so the illuminating and sound system may be seen clearly according to a preferred embodiment.
Figure 3:
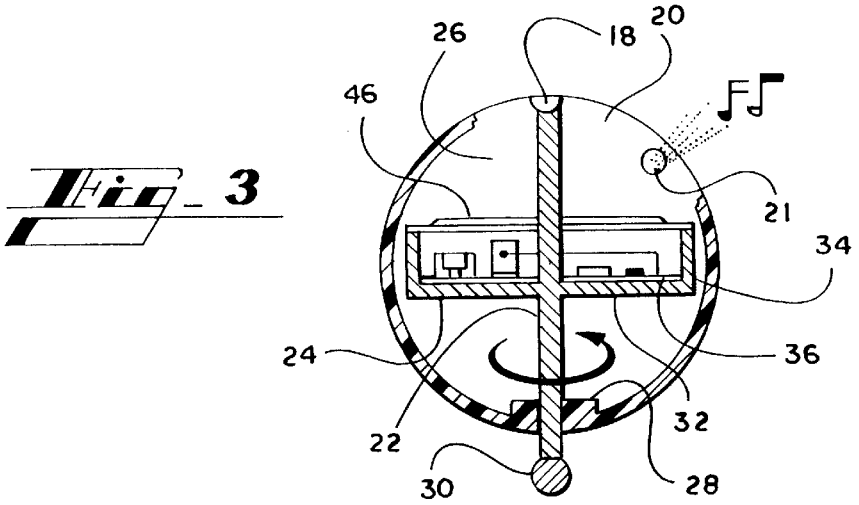
FIG. 3 is a partial cross sectional view of the string activated rotatable toy of the present invention according to a preferred embodiment.

The toy 5 of FIG. 1 comprising an outer casing 20 is shown in cutaway in FIG. 3 and in full view in FIGS. 1 and 2. Casing 20 contains a rotatable toy assembly 18 which consists of a shaft 22 and a joined integral rotor 24. Casing 20 contains several spaced apart sound holes 21, a representative number of them shown in FIGS. 1 and 2, for allowing sound generated from within the casing 20, to escape therefrom and be heard by the user. Shaft 22 is pivoted at the top and bottom of casing 20 by upper and lower bearings 26 and 28. One end of shaft 22 extends out through bottom bearing 28 and the bottom of casing 20 and has a friction roller 30 mounted at its lower end. Upper bearing 26 provides a pivot for shaft 22. Upper end of shaft 22 extends to the outer end of casing 20 through aperture 18 which is at the top of the casing 20 and from there shaft 22 penetrates boss 60 which is at the center of a sponge disk 10 affixed near the upper end of shaft 22.

As best seen in FIG. 3, rotor 24 consists of a circular metal disk 32 which has a circular integral 34 extending up from its outer edge. Mounted around shaft 22, is a printed circuit board (PCB) 36 which is populated with illuminating and sound generating electronic components.

FIG. 2 makes more visible the interior of the invention 5. The components on board 36 of FIG. 3 are shown in greater detail in FIGS. 4 and 5 and schematically in greater detail in FIG. 6.

Figure 4:
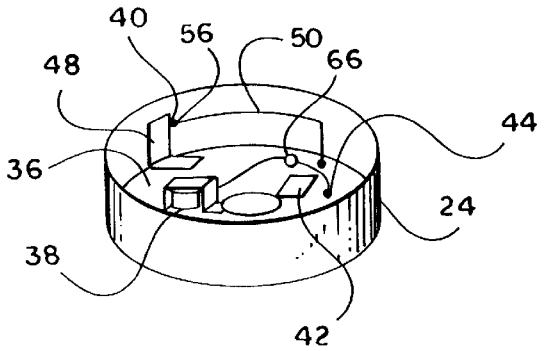
FIG. 4 is a perspective view of the tune-playing and illuminating device of the string activated rotatable toy of the present invention with its top removed according to a preferred embodiment.
Figure 5:
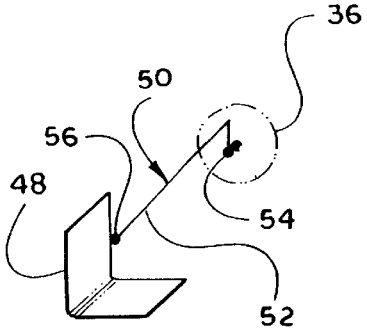
FIG. 5 is a perspective view of centrifugal switches according to the string activated rotatable toy of the present invention according to a preferred embodiment.
Figure 6:
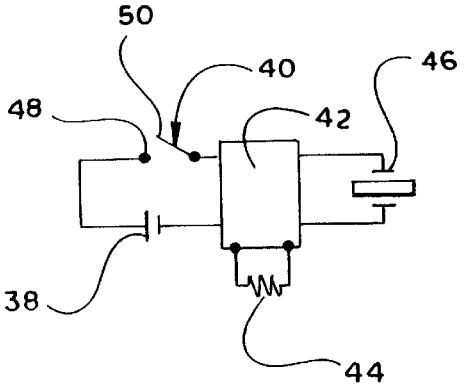
FIG. 6 is a schematic diagram of a representative electronic circuit used in the invention.

FIG. 4 shows a perspective view of rotor 24 with PCB 36 and its electronic components without shaft 22. In practice, rotor 24 and shaft 22 may be cast integrally. As best seen in FIGS. 4–6, the components on the PCB 36 comprise an energy cell 38 which is connected in series with a centrifugally operated switch 40 and the input terminals of a bulb 66 and a sound synthesizer 42. Output terminals of bulb 66 and synthesizer 42 are connected to drive a piezoelectric audio transducer 46. Further, control terminals of bulb 66 and synthesizer 42 are connected to a resistor 44 which controls the operating frequency and hence the tempo of the output of synthesizer 42 and the illumination of bulb 66.

Energy cell 38 is preferably of the 1.3 to 1.5 volt mercury or silver type used in conventional electronic watches and hearing aids. These are attached to PCB 36 both physically and electronically by means of underlying traces (not shown) and a conventional clamp arrangement which is soldered to other traces on the PCB 36 (not shown). Switch 40 consists of a fixed contact 48 and a movable contact 50. Fixed contact 48, shown in more detail in FIG. 5, consists of two flat, rectangular conductive slats which are joined together at a bend to provide an L-shaped contact; the horizontal plate being soldered to a trace (not shown) on PCB 36. Movable contact 50 consists of a wire 52, one end of which has a short horizontal section (FIG. 4) which is soldered to a trace on PCB 36 as shown at 54 in FIG. 5. Wire 52 has a short vertical portion extending upward from PCB 36, and finally along horizontal section, the end of which terminates in a ball 56 which provides a weighted contact. Ball 56 is positioned within the confines of L-shaped fixed contact 48, in other words, it faces both the horizontal and vertical members of the "L".

Bulb 66 and sound synthesizer 42 are arranged to generate light and sound whenever their input terminals are energized from cell 38. Such electronic light and sound system are well-known in the art and widely available and may be ordered easily. Illuminating and sound producing components comprise bulb 66 and a synthesizer 42, which has an oscillator arranged to provide a continuous super-audible signal to a bank of frequency dividers. The bank of dividers is arranged to divide the signal from the oscillator down to the desired plurality of music-frequency signals (i.e., the notes of the melody to be played) and supply these to a plurality of transmission gates which can gate any one of the music signals to an amplifier. The gates are controlled by a ROM (Read only memory), which has a plurality of storage cells. The storage cells are sequentially addressed by a program counter (also driven by the oscillator), thereby providing data outputs from information stored in the cells so as to render selected gates transmissive in the proper order to provide the predetermined melody at the synthesizer's output terminals.

Piezoelectric transducer 46 consists of a piezoelectric crystal sandwiched between two electrodes. When energized with any of a variety of signals, the crystal will vibrate at said frequency, thereby providing an audible tonal output. The transducer comprises a relatively large, plate-like structure and it is adhesively mounted across the top of flange 44. The transducer 46 is provided with a hole (not shown) in its center to accommodate shaft 22. Leads of transducer 46 have been omitted for clarity.

The switch of FIG. 5 will be closed (i.e., conductive or transmissive) whenever movable contact 50 operates to the left or down. This occurs because ball contact 56 will thereupon meet either of the plates of fixed contact 48.

Returning to FIG. 1, the disk 10 is made of sponge similar material to ensure that the toy is safe enough for any user or any spectator. Although casing 20 is shown in sperical form, casing 20 may be made in other shapes and forms. It could be made of any form desired by the manufacturer. This casing 20 could also be constructed from a substantially thin, rigid plastic: but, any other suitable material for its fabrication could be considered by a manufacturer. Shaft 22 has a hole 13 formed at the center through which string 14 is attached in one end to shaft 22. String 14 has two knots 76 and 77, one knot is formed in each side of shaft 22 to assure that the string 14 stays attached to shaft 22. Casing 20 has a bore formed at the equatorial diameter through which string 14 passes from said casing and curves around at ring 16 through aperture 17 and forms a knot 78. Ring 16 constitutes a holding means with a central aperture 17 made large enough to fit a user's finger. Ring 16 may be made of any suitable material such as plastic, wood or metal.

In use, and with continuing reference to FIGS. 1–6, casing 20 is held in one hand of the user between his/her fingers. Then, with one finger of the other hand, the user softly pushes the disk clockwisely (or counterclockwisely) so as to get the string 14 completely rolled about shaft 22. At that point, the user engages the holding means 16 by inserting a finger through aperture 17 of the holding means 16. Then, the user moves the holding means out in a direction as shown in FIG. 2 along the axis of string 14 to cause said string to unwind. Shaft 22 will rotate in the same direction with string 14 then would rotate opposite direction because of centrifugal force. That rotation will cause string 14 to rewind again. This reciprocating motion between the user's hands causes the disk to oscillate back and forth as long as the user desires. In accordance with the invention, when rotor 24 rotates, centrifugal force will be applied to ball contact 56. This will cause the ball to move outward and contact the vertical plate of fixed contact 48, closing switch 40. Ball 56 can so move because wire 52 of movable contact 50 is positioned near the outer edge of the rotor 24 and is substantially perpendicular to an imaginary radius of rotor 24. This allows wire 52 to bend outwardly in an arc about its point of attachment 54 so that ball 56 can contact the vertical plate of fixed contact 48 as stated.

When switch 40 closes, cell 38 energizes bulb 66 so it becomes illuminated and synthesizer 42 supplies a signal representative of the predetermined tonal signal to transducer 46. Transducer 46 emits an audible sound representative of the tonal signal, which resonates on PCB 36 and passes out of the casing via its sound holes, 21.

At that moment the string rotatable toy 5 is illuminated and playing a chosen nice melody which makes the invention smooth in its operation and further providing a complete package of enjoyment. This process may be continued as long as the user desires.

Although no exact method or material of fabrication is specifically described with the detailed description of the preferred embodiments of the invention, it will be apparent to those skilled in the art that various materials and methods consistent with the manufacturing of the toys are available.

A preferred material is a plastic such as polyethylene, which has been injection molded to created an attractive visual display. Certain figures such as animals or cartoon characters could be placed over the casing. In certain cases, colorful designs upon the disk 10 create a profusion of color or optical illusion as the object rotates to enhance the amusement quality of the toy. And the strings may be formed of any suitable material, but nylon is preferred over cotton for durability, longer useful life and smoother operation.

The invention has been described in preferred form only, and by way of examples, and many variations may be made in the invention which will still be comprised within its spirit and scope. It is understood, therefore, that the invention is not limited to any specific form or embodiment except in so far as such limitations are included in the appended.

I claim:

1. A string activated rotatable device, comprising:

a. a shaft;

b. a casing carried by said shaft, said casing having a plurality of apertures and a bore formed thereon said casing;

c. a disk carried by said shaft;

d. a string having a distal end and a proximal end, said proximal end of said string extending through said bore of said casing and attached to said shaft;

e. a means for producing an illumination carried by said shaft within said casing, wherein said illumination producing means is activated by rotation of said device; and, f. a means for producing a sound carried by said shaft within said casing, wherein said sound producing means is activated by rotation of said device, wherein when said shaft is rotated in one direction, said string winds around said shaft, said sound producing means generates a sound which is allowed to emit from said casing through said plurality of apertures, and said illumination producing means generates an illumination which is allowed to emit from said casing through said plurality of apertures, and wherein when said shaft is rotated in the opposite direction, said string unwinds from said shaft, said sound producing means generates a sound which is allowed to emit from said casing through said plurality of apertures, and said illumination producing means generates an illumination which is allowed to emit from said casing through said plurality of apertures.

2. The device of claim 1, wherein said disk is made of sponge material.

3. The device of claim 1, further comprising a holding means carried by said distal end of said string.

4. The device of claim 3, wherein said holding means is a ring.

5. The device of claim 1, wherein said disk is phosphorescent.

6. The device of claim 1, wherein said disk has a plurality of colors for enhancing and reflecting the light emitting from said casing.

7. The device of claim 1, wherein said sound producing means is a printed circuit board means.

8. The device of claim 1, wherein said illumination producing means is a printed circuit board means.

9. A string activated rotatable device, comprising:

a. a shaft;

b. a casing carried by said shaft, said casing having a bore;

c. a disk carried by said shaft;

d. a string having a distal end and a proximal end, said proximal end of said string extending through said bore of said casing and attached to said shaft, wherein when said shaft is rotated in one direction, said string winds around said shaft, and wherein when said shaft is rotated in the opposite direction, said string unwinds from said shaft e. said casing further comprises a plurality of apertures formed thereon said casing;

d. a means for producing an illumination, said illumination producing means carried by said shaft within said casing, said illumination producing means activated by rotation of said device, wherein said illumination producing means generates an illumination emitting from said casing through said plurality of apertures when said shaft is rotated.

10. The device of claim 9, further comprising a means for producing a sound, said sound producing means carried by said shaft within said casing, said sound producing means activated by rotation of said device, wherein said sound producing means generates a sound emitting from said casing through said plurality of apertures when said shaft is rotated.

11. The device of claim 10, wherein said sound producing means is a printed circuit board means.

12. The device of claim 10, wherein said illumination producing means and said sound producing means is a printed circuit board means.

13. The device of claim 9, wherein said disk is made of sponge material.

14. The device of claim 9, further comprising a holding means carried by said distal end of said string.

15. The device of claim 14, wherein said holding means is a ring.

16. The device of claim 9, wherein said disk is phosphorescent.

17. The device of claim 9, wherein said illumination producing means is a printed circuit board means.

* * * * *